United States Patent [19]

Miano et al.

[11] 4,233,993

[45] Nov. 18, 1980

[54] SMOKING MATERIAL

[75] Inventors: Ralph R. Miano; Charles H. Keith, both of Charlotte, N.C.

[73] Assignee: Celanese Corporation, New York, N.Y.

[21] Appl. No.: 887,572

[22] Filed: Mar. 17, 1978

Related U.S. Application Data

[63] Continuation of Ser. No. 607,301, Aug. 25, 1975, abandoned, which is a continuation of Ser. No. 400,465, Sep. 24, 1973, abandoned, which is a continuation of Ser. No. 216,763, Jan. 10, 1972, abandoned, which is a continuation-in-part of Ser. No. 841,969, Jul. 15, 1969, abandoned.

[51] Int. Cl.[3] ..... A24B 5/16; A24D 1/18

[52] U.S. Cl. ..... 131/2; 131/140 P; 131/140 C

[58] Field of Search ..... 131/2, 15 C, 140 C, 131/17 A, 17 AE, 140 P

[56] References Cited

U.S. PATENT DOCUMENTS

| | | | |
|---|---|---|---|
| 2,809,904 | 10/1957 | Korel | 131/2 |
| 2,930,720 | 3/1960 | Finberg | 131/17 |
| 3,106,210 | 10/1963 | Reynolds et al. | 131/17 R |
| 3,125,089 | 3/1964 | Osfarne | 131/17 |
| 3,404,690 | 10/1968 | Moshy et al. | 131/140 |
| 3,477,865 | 11/1968 | Armbrust et al. | 131/17 UX |
| 3,528,434 | 9/1970 | Halter et al. | 131/140 P |
| 3,529,602 | 9/1970 | Hind et al. | 131/2 |
| 3,746,012 | 7/1973 | Deszyck | 131/140 P |
| 3,931,824 | 1/1976 | Miano et al. | 131/2 |

FOREIGN PATENT DOCUMENTS

| | | | |
|---|---|---|---|
| 687507 | 3/1967 | Belgium | 131/2 |
| 1517264 | 7/1972 | Fed. Rep. of Germany | 131/2 |

OTHER PUBLICATIONS

"Tobacco and Tobacco Smoke", by Wynder et al., Academic Press, New York and London, pp. 330 and 350.

"The Chemistry and Technology of Tobacco", by Shmuck published by Pishchepromizdat, Moscow, 1953, pp. 602 and 603.

*Primary Examiner*—V. Millin

*Attorney, Agent, or Firm*—Andrew F. Sayko, Jr.

[57] ABSTRACT

Tobacco substitutes exhibiting improved particulate matter delivery and pressure drop characteristics are prepared by producing a film containing a blowing agent and heating the film to a temperature sufficient to cause gasification of the blowing agent.

10 Claims, No Drawings

SMOKING MATERIAL

This is a continuation, of application Ser. No. 607,301, filed Aug. 25, 1975 now abandoned, which in turn is a continuation of application Ser. No. 400,465 filed Sept. 24, 1973 now abandoned, which in turn is a continuation of application Ser. No. 216,763 filed Jan. 10, 1972 now abandoned, which in turn is a continuation-in-part of application Ser. No. 841,969 filed July 15, 1969 now abandoned.

The present invention relates generally to smoking products and more specifically to synthetic materials suitable for use as tobacco substitutes.

Many attempts have been made to devise a commercially acceptable substitute for tobacco of the many substitutes proposed, the ones appearing most promising comprise synthetic films, usually modified by the dispersion therein of one or more materials which control the rate of combustion of the film. Recent prior art describing substitutes prepared from synthetic films include, for example, Netherlands Pat. No. 67,08411 which relates to tobacco substitutes prepared from films of acid gums having a high acid value, e.g., pectinaceous films having an acid value in excess of 30 m.g. of KOH per gram of gum.

Tobacco substitutes exhibiting particularly desirable properties are described in U.S. application, Ser. No. 696,699, now abandoned, to the assignee of the present invention. Essentially, the materials described in that application are films of a film-forming substance selected from the group consisting of starch, and starch and cellulose derivatives containing certain combustion modifiers.

Although tobacco substitutes of the type exemplified above exhibit many desirable properties, improvements are still needed. For example, the amount of particulate matter delivered upon combustion of an equivalent volume of tobacco, could be desirably further decreased. Also, smokable columns, i.e., cigarette-like products, prepared from the above materials tend to exhibit a lower pressure drop, i.e., resistance to draw than comparable tobacco columns. This lower pressure drop, since it differs from that of tobacco tends to lessen the commercial acceptibility of the substitute. Tobacco substitutes of the presently described type are further improved in these respects by the practice of the present invention.

Specifically, it is an object of the present invention to provide a process for preparing improved tobacco substitutes.

It is another object to provide a process for preparing tobacco substitutes producing low amounts of particulate matter upon combustion.

Another object of the present invention is to provide a process for producing a smokable column containing a tobacco substitute which will exhibit a pressure drop similar to that of a tobacco containing column of comparable size.

A further object is to provide a tobacco substitute which yields low amounts of particulate matter upon combustion.

Yet another object is to provide a smokable column containing a tobacco substitute which will exhibit a pressure drop approximating that of a tobacco containing column of equivalent size.

Other objects of the present invention, if not specifically set forth herein, will be obvious to one skilled in the art upon a reading of the following detailed description.

Generally, the aforesaid objects are achieved by incorporating a blowing agent, hereinafter defined, into the desired matrix material prior to film formation, producing a film of the matrix material containing the blowing agent and any other additives by casting, extruding, or otherwise, and subjecting the film to conditions causing gasification of the blowing agent.

The term "blowing agent" as employed in the present description is intended to include compounds which will, upon heating, produce a gas by either vaporization or gaseous decomposition. Compounds employed and the decomposition products thereof remaining in the blown film, if any, should, of course, be nontoxic to the smoker at the level present.

Exemplary of suitable blowing agents having utility in the practice of this invention are ammonium bicarbonate, water, heptane and fluorinated hydrocarbons. Particularly desirable blowing agents are ammonium carbonate, hexane and trifluro, trichloro ethane.

The matrix materials used to produce the present tobacco substitutes are nontoxic substances which, like the above blowing agents, will not yield decomposition products toxic to the smoker at the level present. More specifically, suitable matrix materials include the naturally occuring plant gums and resins such as gum guar, gum arabic, locust bean gum, tamarind seed gum; the pectins and amylopectins; corrageenin; alginates; starches and dextrins. Particularly suitable matrix materials are the starch and cellulose derivatives having the formula:

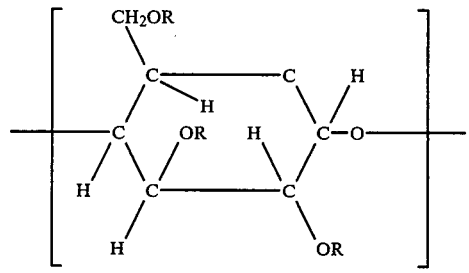

wherein at least one R is selected from the group consisting of lower alkyl, hydroxy lower alkyl, carboxy lower alkyl groups, and mixtures thereof, and the remaining Rs are hydrogen atoms. Preferably, R is selected from the group consisting of $CH_2COOM$, $CH_2CH_2OH$ and $CH_3$; in which M is a non-toxic cation or hydrogen, and preferably is selected from the group consisting of alkali metals and alkaline earth metals, aluminum, iron and hydrogen. Compounds of the above nature ordinarily have an average degree of substitution of hydrogens of from about 0.2 to about 3.0 R groups per unit, and preferably have from about 0.4 to about 1.2 groups per unit. Mixtures of these matrix materials may also be suitably employed.

Matrix materials particularly suitable in the present invention are carboxymethyl cellulose, hydroxyethyl cellulose, methyl cellulose, carboxymethylated starch, and the like.

The combustion characteristics of films prepared from the above matrix materials are ordinarily modified to produce a product having a burning rate analagous to that of tobacco by the incorporating into the matrix material of one or more modifiers. Suitable combustion modifiers may be selected from organic compounds, inorganic compounds and the elements, so long as the material is non-toxic, i.e., pharmacologically inactive in the sense of significant adverse effects in a causative relationship upon oral ingestion of the substance itself or its combustion products. Best results are more readily observed when the combustion modifier comprises an inorganic compound, an element or a mixture thereof.

Inorganic compounds suitable as fillers preferably consist of a cation selected from Column (A) and an anion selected from Column (B).

| (A) | | | (E) |
|---|---|---|---|
| Lithium | Manganese | Silicon | Oxides |
| Sodium | Aluminum | Palladium | Hydrated Oxides |
| Potassium | Cerium | Tin | Hydroxides |
| Cesium | Cobalt | Zinc | Carbonates |
| Magnesium | Iron | Titanium | Phosphates |
| Calcium | Molybdenum | Zirconium | Aluminates |
| Strontium | Nickel | Copper | Stannates |
| Barium | Rubidium | | Zincates |
| | | | Silicates |
| | | | Carbides |

The most preferred inorganic compounds have been found to be the alkali metals and alkaline earth metal carbonates, oxides, silicates, aluminosilicates, aluminates, and aluminum hydroxide. Inorganic compounds in their naturally occuring state, such as dolomite, perlite, magnesite, diatomaceous earth, vermiculite, etc., are also suitable in the present invention.

A combustion modifier in particulate form having an average minimum dimension of from about 0.2 microns to about 1.0 millimeter, and preferably from about 0.2 to about 0.5 millimeters will ordinarily be employed. A weight to weight ratio of from about 85:15 to about 15:85, and preferably from about 25:75 to about 75:25, matrix material to combustion modifier will ordinarily be used.

Additional materials which may be added in minor amounts include ash modifiers, such as fiberglass and organic fibers; flavor and odor modifiers, such as tobacco extracts, synthetic flavors or sugars; coloring agents, such as carbon, food dyes and inorganic pigments; plasticizers and humectants, such as butylene glycol, glycerol and propylene glycol; and wetting agents.

In preparing the present tobacco substitutes, the blowing agent and matrix material, along with combustion modifiers and any other desired additives, are added to water and intimately blended. Ordinarily from about 0.1 to about 10%, and preferably from about 0.2 to about 5% of blowing agent based on the weight of the total solids will be employed. The total mixture will ordinarily contain from about 65 to 95% water. Although use of percentages of water outside this range is possible, increased processing difficulties result.

After intimate blending, the mixture is formed into a film, for example, by extrusion or casting onto a suitable surface.

The wet film is then heated to a temperature sufficient to cause gasification of the blowing agent. The film should not, of course, be heated to above the decomposition temperature of the matrix material or other decomposable additives. A blowing agent having a gasification temperature below the decomposition temperature of the other ingredients should, therefore, be used. For this reason, blowing agents having a gasification temperature of from about 25° to about 125° C., and preferably from about 50° to about 105° C. will ordinarily be employed. Best blowing is obtained when the film is rapidly heated to the gasification temperature, e.g., within 10 minutes.

The resultant film is of a porous nature and has a density of from about 0.3 to about 0.6 g/cc. Ordinarily, the dried film will have a thickness of from about 3 to about 20 mils, and preferably from about 5 to 10 mils.

Smoking columns of 85 mm length and 8 mm diameter containing 1.1 g filler prepared from the present blown films in a conventional manner have a pressure drop of from about 41 to about 77 mm $H_2O$ as opposed to a pressure drop range of about 15 to about 24 mm $H_2O$ obtained in the preparation of smoking columns from an otherwise comparable unblown film. Conventional all-tobacco cigarettes of the same size and weight have a pressure drop of from about 60 to 100 mm $H_2O$. Also, the cigarettes prepared from the blown films yield a lower amount of tar, i.e., from 1 to about 3 milligrams per smoking column as opposed to about twice as many milligrams per equivalent smoking column from a comparable unblown filler and 20 to 30 millimeters per cigarette from an all-tobacco filler. These ranges are, of course, for the unfiltered product, it being understood that a filter will produce a comparable decrease in all of the foregoing amounts.

The following examples are presented for the purpose of illustration only and are not to be taken as limiting the scope of the present invention.

EXAMPLE I

An unblown control film was prepared by casting an intimate mixture of 14 parts carboxymethyl cellulose, 14 parts dolomite, 4 parts carbon, 2.4 parts wetting agent, 0.14 parts crosslinking agent and 0.06 parts coloring agent to a final dried film thickness of 5–7 mils. A second film was prepared by casting a film from the preceding mixture additionally containing 5% ammonium carbonate as a blowing agent. This latter film was heated to 115° C., the gasification temperature of ammonium carbonate being 58° C. The films were then shredded and formed into smoking columns of 85 mm in length and 8 mm in diameter. The results obtained are compared with those of an all-tobacco cigarette in the following table.

Table 1

| Sample | Sheer Density g/cc | Shred Wt. g | % Compressibility | ΔP mm $H_2O$ | Dry Pad Tar mg/cig |
|---|---|---|---|---|---|
| Blown Film | 0.42 | 0.90 | 43 | 77 | 2.0 |
| Unblown Film | 0.60 | 1.10 | 42 | 24 | 4.9 |
| Tobacco Control | 0.51–0.63 | 1.10 | 41 | 82 | 24.7 |

In the above data, a shred wt. of 0.90 g was used instead of 1.10 g in order to produce a pressure drop comparable to that of the tobacco control. A smoking column containing 1.10 g blown film had a pressure drop of 177 mm $H_2O$. It is interesting to note, however, that the substantial decrease in tar (4.9 to 2.0 mg/cig) is greater than is to be expected from the minor decrease in shred weight. It is believed that this unexpected decrease is attributable to the increased filtration of the higher pressure drop column. It was also noted that there was no adverse affect of compressibility.

EXAMPLE II

Films were also prepared from a mixture of 14 parts carboxymethyl cellulose, 14 parts dolomite, 10 parts magnesium oxide, 2.4 parts wetting agent, 0.14 parts crosslinking agent and 0.4 parts coloring agent. Again, 5% ammonium carbonate was used as the blowing agent. A reduction in sheet density from 1.17 g/cc to 0.77 g/cc was obtained. A reduction in tar delivery comparable to the reduction shown in Example I also results.

EXAMPLE III

In order to determine the relationship of percent blowing agent to film density, films prepared from the formulation of Example I were blown with different percentages of a blowing agent, specifically ammonium carbonate. The following results were obtained:

| % Blowing Agent | Film Density, g/cc |
|---|---|
| 0.0 | 0.60 |
| 0.5 | 0.49 |
| 1.0 | 0.44 |
| 3.0 | 0.42 |
| 5.0 | 0.42 |

From the above results it is concluded that maximum blowing efficiency is achieved using up to 3.0% blowing agent. Also, the value of the present invention is best observed using at least 1% blowing agent.

Smoking products may be prepared entirely from the herein described materials or from such materials in any desired combination with tobacco, reconstituted tobacco, or other tobacco substitutes.

While the present invention has been described with specific examples, it is to be understood that many modifications may be made thereto without departing from the spirit and scope thereof. For example, the substitute may be extruded in fibrous form instead of film form.

Having thus disclosed the invention, what is claimed is:

1. A process for preparing a material containing substantially no tobacco suitable for use in smoking products comprising intimately mixing a film-forming, nontoxic combustible matrix comprising as the primary combustible material at least one film-forming cellulose ether selected from the group consisting of carboxymethyl cellulose, carboxymethyl cellulose salts, carboxyethyl cellulose, hydroxyethyl cellulose, methyl cellulose, ethyl cellulose, hydroxypropyl cellulose, and carboxymethyl hydroxyethyl cellulose, with a combustion modifier consisting essentially of at least one particulate filler selected from the group consisting of titanium dioxide, magnesium oxide, silica gel, sodium alignate, silica aluminate, calcium carbonate, diatomaceous earth, dolomite, carbon, perlite, magesite, zeolite and vermiculite; said primary combustible material and said film former being present in a weight to weight ratio of about 15:85 to about 85:15, and up to 5 percent by weight of the mixture of a blowing agent, forming a film from the mixture, and heating said film to above the gasification temperature of said blowing agent to produce a blown film having a density of from about 0.3 to about 0.6 gram per cubic centimeter.

2. The process of claim 1 wherein said combustible material is selected from the group consisting of carboxymethyl cellulose and carboxymethyl cellulose salts.

3. The process of claim 1 wherein said particulate filler is selected from the group consisting of calcium carbonate, magnesium carbonate, dolomite, carbon and perlite.

4. The process of claim 1 wherein said blowing agent is selected from the group consisting of ammonium carbonate, hexane, and fluorinated hydrocarbons.

5. The process of claim 1 wherein said blown film is subsequently shredded.

6. A smoking material in film form containing substantially no tobacco and comprising as the primary combustible material at least one film-forming cellulose ether selected from the group consisting of carboxymethyl cellulose, carboxymethyl cellulose salts, carboxymethyl cellulose, hydroxyethyl cellulose, methyl cellulose, ethyl cellulose, hydroxypropyl cellulose, and carboxymethyl hdyroxyethyl cellulose; at least one particulate filler selected from the group consisting of titanium dioxide, magnesium oxide, silica gel, sodium alignate, silica aluminate, calcium carbonate, diatomaceous earth, dolomite, carbon, perlite, magesite, zeolite and vermiculite; said primary combustible material and said film former being present in a weight to weight ratio of about 15:85 to about 85:15; said film having a density of 0.3 to 0.6 gram per cubic centimeter.

7. The smoking material of claim 1 wherein said combustible material is selected from the group consisting of carboxymethyl cellulose and carboxymethyl cellulose salts.

8. The smoking material of claim 1 wherein said particulate filler is selected from the group consisting of calcium carbonate, magnesium carbonate, dolomite, carbon and perlite.

9. The smoking material of claim 1 wherein said film is from 3 to 20 mils in thickness.

10. The smoking material of claim 1 in shred form.

* * * * *